United States Patent [19]

Katona

[11] 4,383,519

[45] May 17, 1983

[54] DOOR FRAME AND HANDLE COMBINATION

[75] Inventor: Joseph W. Katona, Walled Lake, Mich.

[73] Assignee: Mills Products, Inc., Farmington, Mich.

[21] Appl. No.: 272,109

[22] Filed: Jun. 10, 1981

[51] Int. Cl.[3] ..... F24C 15/04; A47B 95/02; A47H 1/14

[52] U.S. Cl. ..... 126/190; 312/320; 248/251

[58] Field of Search ..... 126/190, 192, 198; 312/311, 314, 320; 49/460; 16/111 R, 110 R; 52/716; 211/123, 105.1; 248/251; 74/543, 546

[56] References Cited

U.S. PATENT DOCUMENTS

| | | | |
|---|---|---|---|
| 2,464,343 | 3/1949 | Praeger | 312/320 X |
| 2,805,911 | 9/1957 | Anderson | 312/320 |
| 2,827,555 | 3/1958 | Woolley | 211/123 |
| 3,860,308 | 1/1975 | Burke | 312/320 X |
| 3,953,094 | 4/1976 | Brown | 312/320 X |
| 4,074,677 | 2/1978 | Lotz | 126/198 |
| 4,087,143 | 5/1978 | Barnard | 126/190 |

*Primary Examiner*—Samuel Scott
*Assistant Examiner*—G. Anderson
*Attorney, Agent, or Firm*—Barnes, Kisselle, Raisch, Choate, Whittemore & Hulbert

[57] ABSTRACT

An oven door in which the top section or member of the door frame has a forward extension that serves as a door handle. End caps are secured to the door frame at the ends of the top frame member and cover and conceal the mitered corners at the top of the door. In a second embodiment the door frame has a bar-type handle.

14 Claims, 8 Drawing Figures

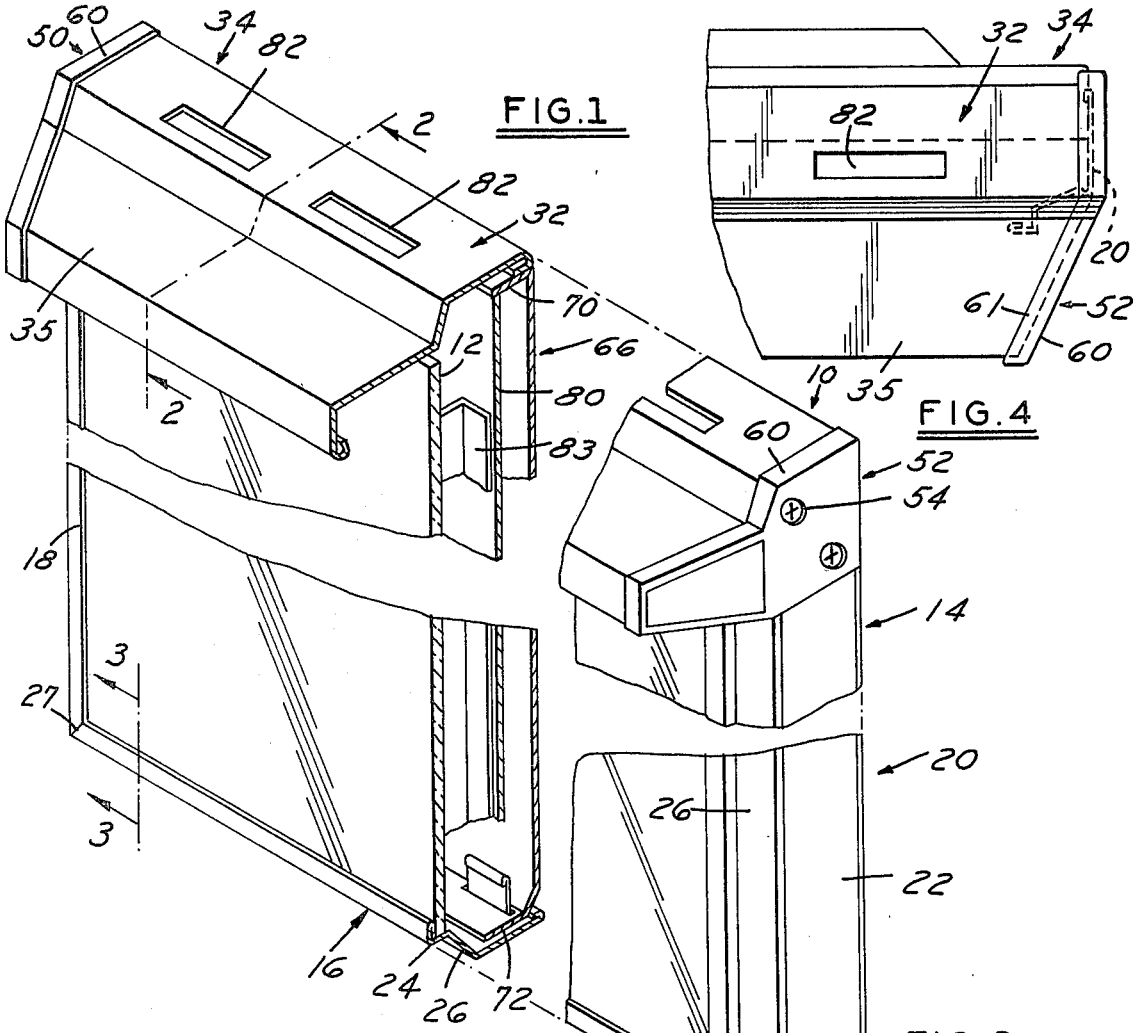
FIG.1
FIG.4
50
60
34
82
2
82
32
35
70
12
66
80
83
2
18
3
27
3
16
24
26
72
10
35
60
52
54
14
20
26
22
27
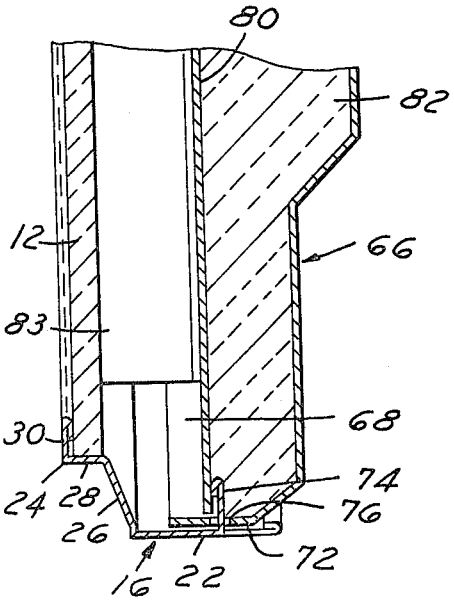
FIG.3
80
82
12
66
83
68
30
74
24
28
76
26
72
16
22
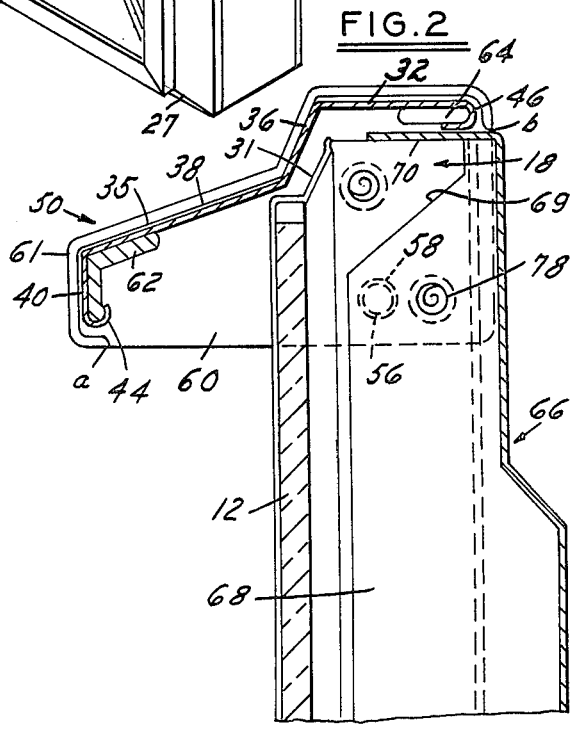
FIG.2
32
64
46
b
36
31
38
70
18
69
50
35
61
62
58
78
40
a
44
60
56
66
12
68

DOOR FRAME AND HANDLE COMBINATION

This invention relates generally to an oven door and refers more particularly to a door frame and handle combination.

SUMMARY OF THE INVENTION

In accordance with a specific embodiment of the invention about to be described, the top section or member of the door frame has an integral, forward extension which serves as a door handle. End caps are secured to the side frame members and cover the upper edges of the side frame members as well as the ends of the top frame member and the forward extension thereof. This construction eliminates the need for a separately mounted handle. The end caps also cover and conceal the mitered corners of the frame at the top of the door. The bottom of the door frame has tabs which fit into the back panel to reduce the number of screws needed to secure the back panel to the frame.

In accordance with another embodiment, the door frame has a bar-type handle. The top corners of the frame are concealed by the end caps. A separate handle bar is supported between the forward extensions of the end caps.

Other objects of the invention will become apparent as the following description proceeds, especially when considered with the accompanying drawings.

BRIEF DESCRIPTION OF THE DRAWINGS

FIG. 1 is a perspective view, with parts broken away, of an oven door constructed in accordance with the invention.

FIG. 2 is a sectional view taken on the line 2—2 of FIG. 1.

FIG. 3 is a sectional view taken on the line 3—3 in FIG. 1.

FIG. 4 is a fragmentary top elevation view.

DETAILED DESCRIPTION

Figure 6:
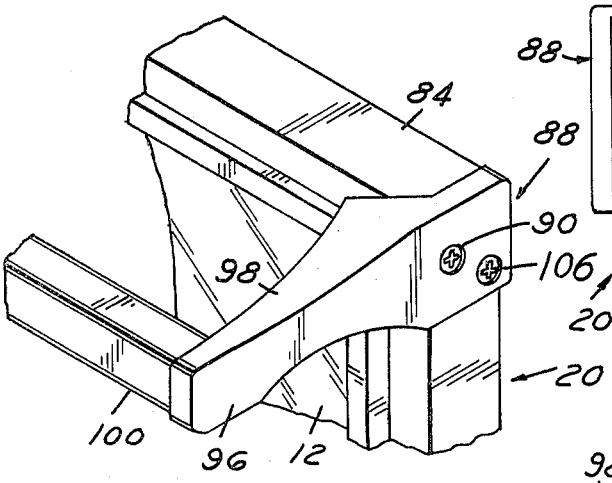
FIG. 6 is a fragmentary perspective view of an upper corner of an oven door of modified construction.
Figure 9:
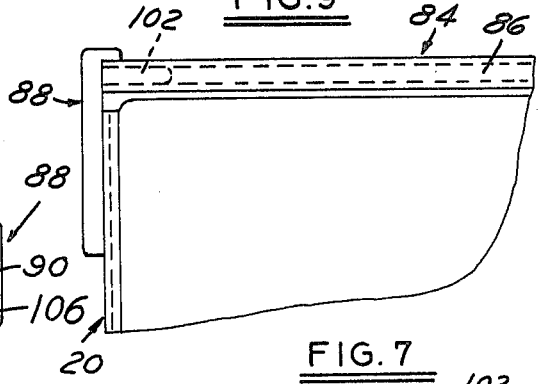
FIG. 9 is a fragmentary view of the corner shown in FIGS. 6–8 as seen from the rear.

Referring now more particularly to the drawings, and especially FIGS. 1–5 thereof, an oven door is generally indicated at 10 having a rectangular glass pane 12 mounted in a rectangular door frame 14.

The door frame 14 has a horizontal bottom frame member 16, and laterally spaced side frame members 18 and 20 integrally connected to and extending vertically upwardly from the opposite ends of the bottom frame member. Each of the bottom and side frame members has a main portion 22 disposed at right angles to the plane of the door and connected to an L-shaped pane-supporting portion 24 by an inclined portion 26. The pane-supporting portion 24 has a part 28 generally parallel to the main portion 22 and an inwardly extending flange 30. The rear edge of main portion 22 and the inner edge of flange 30 are rolled over or folded on themselves as shown. The bottom and side frame members 16, 18 and 20 are preferably made from a single straight strip of stock roll-formed to the configuration shown and having the L-shaped pane-supporting portion 24 and the inclined portion 26 notched to permit the strip to be bent to provide mitered corners 27 as shown at the bottom of the door in FIG. 1. The top edges of the side frame members are mitered at 31 along the L-shaped and inclined portions thereof. The glass pane 12 is confined on three sides by the parts 28 of the L-shaped portions 24 of the bottom and side frame members with the flanges 30 overlying the front of the glass pane along the edges thereof.

Integral tabs 29 project from the two ends (only one shown) of the inclined portion 26 of the bottom frame member 16 and extend behind the inclined portions of the side frame members 18 and 20 at the mitered corners at the bottom of the frame. The tabs 29 prevent the bottom frame member 16 from being forced out in a forward direction producing a gap at the mitered corners due to the weight of the glass pane 12.

The top frame member 32 completes the rectangular door frame 14, although it is separate from the bottom and side frame members 16, 18 and 20. Top frame member 32 forms part of the door frame and handle combination 34. The top frame member 32 is disposed at right angles to the plane of the door and extends between the upper edges of the side frame members 18 and 20 above the upper edge of the glass pane 12. The top frame member 32 has an integral forward extension forming a handle portion 35 composed at a downwardly sloped part 36, a forwardly inclined part 38 and a vertical terminal part 40 which has a rolled or return-bent lower edge as indicated at 44. The rear edge of the top frame member is also rolled or return-bent where indicated at 46.

The door frame and handle combination 34 includes in addition to the top frame member 32 the end caps 50 and 52. The end caps are in the form of plates secured to the side frame members 18 and 20 near the upper edges thereof by screw fasteners 54 in abutting relation to the ends of the top frame 32. The end caps also have alignment pegs 56 which extend into recesses or holes 58 in the side frame members. The end caps have forward extensions 60 extending along and abutting the ends of the handle portion 35 of the top frame member. As shown, the end caps have flanges 61 extending continuously from points a to b over the ends of the top frame member and forward extension thereof. The end caps 32 also have inner locating projections 62 and 64 over which the ends of the rear part of the top frame member and the ends of the forward extension 35 thereof extend. The end caps 32 conceal the upper mitered edges or corners of the side frame members 18 and 20 as well as the ends of the top frame member 32.

The door has a rectangular back panel 66 provided with side flanges 68 and top and bottom flanges 70 and 72 which extend forwardly inside the side frame members 18 and 20, the bottom frame member 16 and the top frame member 32. The bottom frame member 16 has upturned tabs 74 projecting through holes 76 in the bottom flange 72 of the back panel. Screw fasteners 78 through the end caps 50 and 52 and also through the side frame members 18 and 20 and the side flanges 68 secure the upper portion of the back panel in place. The upper edges of the side flanges 68 of the back panel are cut down at 69 to clear fasteners 54. Because the tabs 74 locate the back panel 66 at the bottom, only two of the screw fasteners 78 are required.

An air baffle 80 cooperates with the back panel 66 to define a space for insulation 82. L-shaped retainers 83 between the air baffle 80 and the glass pane 12 hold the glass pane in the pane-supporting portion 24 of the frame 14. Ventilating slots 82 may be provided in the top frame member 32 and similar slots (not shown) may also be provided in the bottom frame member 16.

FIGS. 6–9 show a modification having a bar-type handle. The bottom frame member (not shown) and the side frame members of the door frame and the glass pane are the same as the bottom frame member 16 and side frame members 18 and 20 of the door frame 14 and the glass pane 12 shown in the embodiment of FIGS. 1–4 and accordingly the same reference numerals are employed in this embodiment.

The top frame member 84 has a configuration in cross section corresponding generally to that of the side and bottom frame members. Its rear edge is rolled to an open U where indicated at 86 similar to the rear edge configuration of the top frame member 32 in FIGS. 1–5.

Figure 7:
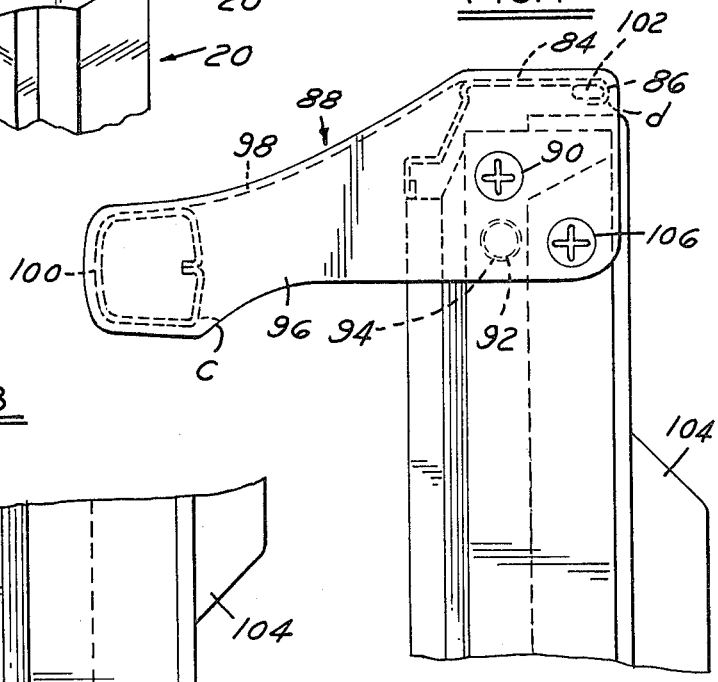
FIG. 7 is a fragmentary end view.
Figure 8:
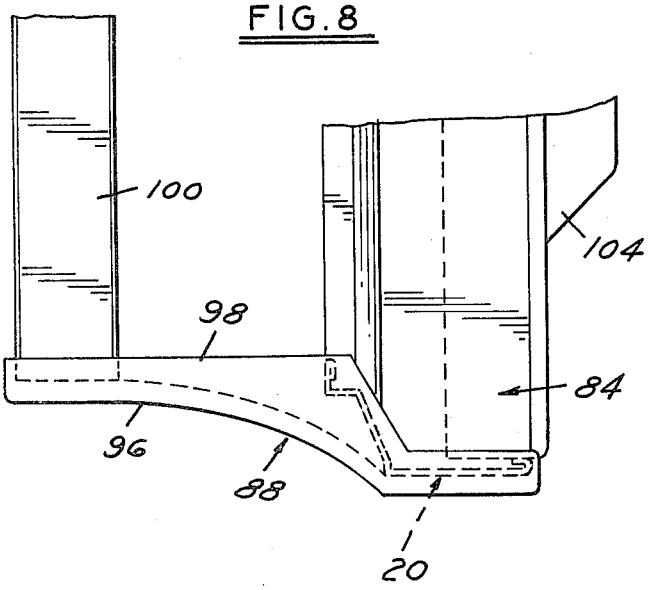
FIG. 8 is a fragmentary top elevation.
Figure 5:
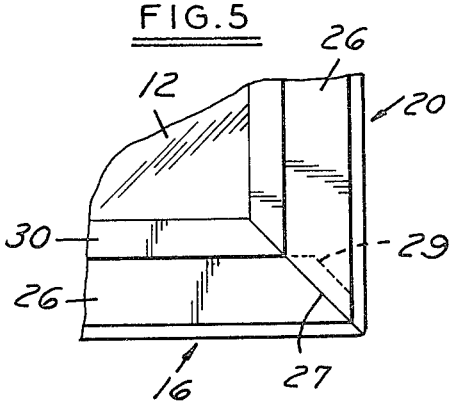
FIG. 5 is a fragmentary view in front elevation in the direction of the arrow in FIG. 1.

The end caps 88 are in general like the end caps 50 and 52 previously described but of a slightly different configuration as will be seen in the drawings. The end caps are mirror images of one another and although only one is shown, it will be understood that the end cap not shown will bear the same relation to the other parts of the assembly as the end cap that is shown. The end caps 88 are in the form of plates secured to the side frame members near the upper edges thereof by screw fasteners 90 in abutting relation to the ends of the top frame member 84. The end caps have alignment pegs 92 which extend into recesses or holes 94 in the side frame members. The end caps have forward extensions 96. The end caps have flanges 98 extending continuously from points c to d over the ends of the top frame member and also over the ends of a bar-type handle 100 which extends between the forward extensions of the end caps in spaced parallel relation to the top frame member. FIG. 7 shows that the bar-type handle may be hollow if desired and is surrounded on more than three sides by the flange 98 so as to be securely held in place. The end caps also have inner locating projections 102 over which the ends 86 of the rear portion of the top frame member extend. The end caps 88 conceal the upper mitered edges or corners of the side frame members 18 and 20 as well as the ends of the top frame member 84.

The back panel 104 is substantially the same as the back panel 66 previously described, although the tops of its side flanges are cut at a slightly different angle as seen in FIG. 7. The bottom of the back panel 104 may be connected to the bottom frame by tabs as in the construction of FIGS. 1–5. The upper portion of the back panel is secured by screw fasteners 106 through the end caps, the side frame members and the side flanges of the back panel.

I claim:

1. In an oven door construction, a glass pane, bottom and side frame members extending along and supporting the bottom and sides of said glass pane, and a top frame and handle combination comprising a top frame member extending between the upper edges of said side frame members across the upper edge of said glass pane, end caps secured to said respective side frame members adjacent the upper edges thereof covering said upper edges and also covering the ends of said top frame member, said end caps having extensions projecting forwardly from said frame members, and a handle member extending between and supported by said end cap extensions, said handle member being an integral forward extension of said top frame member, said end caps, including the forward extensions thereof, being in the form of plates secured in surface-to-surface relation to said side frame members in substantially abutting relation to the ends of said top frame member and forward extension thereof, said plates having flanges extending over the ends of said top frame member and forward extension thereof.

2. Structure as defined in claim 1, wherein said plates have alignment pegs extending into recesses in said side frame members.

3. Structure as defined in claim 1, wherein said plates have locating projections extending under the ends of said top frame member and forward extension thereof.

4. Structure as defined in claim 1, including a back panel, said bottom frame member having panel-mounting tabs, said back panel having openings along its lower edge receiving said tabs, and screws securing said back panel to said end caps.

5. Structure as defined in claim 1, said bottom and side frame members meeting in mitered corners, and means for preventing gaps from developing at said mitered corners due to the weight of said glass pane.

6. In an oven door construction, a glass pane, bottom and side frame members extending along and supporting the bottom and sides of said glass pane, and a top frame and handle combination comprising a top frame member extending between the upper edges of said side frame members across the upper edge of said glass pane, end caps secured to said respective side frame members adjacent the upper edges thereof covering said upper edges and also covering the ends of said top frame member, said end caps having extensions projecting forwardly from said frame members, and a handle member extending between and supported by said end cap extensions, said handle member being an integral forward extension of said top frame member, said end caps having flanges extending over the ends of said top frame member and said handle member.

7. In an oven door construction, a glass pane, bottom and side frame members extending along and supporting the bottom and sides of said glass pane, and a top frame and handle combination comprising a top frame member extending between the upper edges of said side frame members across the upper edge of said glass pane, end caps secured to said respective side frame members adjacent the upper edges thereof covering said upper edges and also covering the ends of said top frame members, said end caps having extensions projecting forwardly from said frame members, and a handle member extending between and supported by said end cap extensions, said end caps having plate portions secured in surface-to-surface relation to said side frame members in substantially abutting relation to the ends of said top frame member and having flanges extending over the ends of said top frame member.

8. Structure as defined in claim 5, wherein said means for preventing gaps comprises tabs on said bottom frame member overlapping said side frame members at said mitered corners.

9. Structure as defined in claim 7, wherein said handle member is an elongated bar separate and spaced from said top frame member.

10. Structure as defined in claim 9, wherein said plate portions have alignment pegs extending into recesses in said side frame members.

11. Structure as defined in claim 9, wherein said plate portions have locating projections extending under the ends of said top frame member.

12. Structure as defined in claim 9, including a back panel, said bottom frame member having panel-mounting tabs, said back panel having openings along its lower edge receiving said tabs, and screws securing said back panel to said end caps.

13. Structure as defined in claim 9, said bottom and side frame members meeting in mitered corners, and means for preventing gaps from developing at said mitered corners due to the weight of said glass pane.

14. Structure as defined in claim 13, wherein said means for preventing gaps comprises tabs on said bottom frame member overlapping said side frame members at said mitered corners.

* * * * *